United States Patent [19]

Ikeda

[11] Patent Number: 4,801,074

[45] Date of Patent: Jan. 31, 1989

[54] SEALED LETTER

[75] Inventor: Etsujiro Ikeda, Yokohama, Japan

[73] Assignees: Jyoni Business Forms Co., Ltd.; Honshu Seishi Kabushiki Kaisha, both of Tokyo, Japan

[21] Appl. No.: 7,247

[22] Filed: Jan. 27, 1987

[30] Foreign Application Priority Data

Jul. 25, 1986 [JP] Japan ..... 36-113495[U]

[51] Int. Cl.[4] ..... B65D 27/04

[52] U.S. Cl. ..... 229/71; 229/68 R; 229/73

[58] Field of Search ..... 229/68 R, 71, 92, 73; 283/79

[56] References Cited

U.S. PATENT DOCUMENTS

| | | | |
|---|---|---|---|
| 3,431,404 | 3/1969 | Brink | 229/68 R |
| 3,507,444 | 4/1970 | Werby | 229/68 R |
| 3,588,456 | 6/1971 | McNabb | 229/68 R |
| 3,777,971 | 12/1973 | Steidinger | 229/68 R |
| 3,899,127 | 8/1975 | Melander | 229/71 |
| 4,640,030 | 2/1987 | Wood et al. | 229/71 |

FOREIGN PATENT DOCUMENTS

| | | |
|---|---|---|
| 3402195 | 7/1984 | Fed. Rep. of Germany . |
| 2134879A | 1/1984 | United Kingdom . |

*Primary Examiner*—Willis Little

*Attorney, Agent, or Firm*—Armstrong, Nikaido, Marmelstein & Kubovcik

[57] ABSTRACT

The invention relates to an envelope having a transparent layer, allowing printed information on the letter paper in the envelope to appear through the envelope. The inner surface of the transparent layer is laminated with a transparent, thermal adhering synthetic resin film to bind the transparent layer to a second layer along their periphery.

8 Claims, 4 Drawing Sheets

SEALED LETTER

BACKGROUND OF THE INVENTION

This invention relates to a sealed letter which is used chiefly for mailing a letter paper such as a bill, a notice or the like suitably printed by a printer without failing.

As for a sealed letter of this kind, there has been hitherto known a type in which an address and any other necessary descriptive matters such as a sum of money or other correspondence items are printed out on predetermined portions of letter paper by a printer of a computer, and the resultant correspondence letter paper is folded and the peripheral portions of the folded one are adhered together to form a sealed letter. To adhere the peripheral portions of the folded letter paper together, the letter paper, in general, is so prepared, prior to being folded, that ruled lines or other necessary matters are printed by an offset duplicator at predetermined portions on the blank of paper and thereafter the resultant letter paper is coated at predetermined peripheral portions with a heat sensitive or pressure sensitive adhesive agent. The letter paper thus prepared as above is applied with the foregoing printing of the address and so on by the printer of the computer and thereafter is folded and the peripheral portions of the folded one are adhered together by applying the heat or pressure to the coating, resulting in a sealed letter.

This conventional type of sealed letter involves various inconveniences as described below:

Recently, among various types of printers, use of a thermal type one has been on the increase and a large quantity thereof are used, but if this thermal printer is used for the letter paper coated with the adhesive agent as mentioned above, the adhesive agent is heated to melt at the time of printing the necessary items on the letter paper to cause trouble to the printer such as blocking to printing. Further, it is necessary for the letter paper to provide for a margin to paste up for applying the adhesive agent thereto, so that the overlap width is not effective for a corresponding part of the letter paper. Furthermore, since the sealed letter is formed by folding and adhering the letter paper, the number of folding thereof is limited, and accordingly the sealed letter folded in four, for instance, is difficult to obtain.

In addition, the letter paper is printed with feed holes for a printer on both side edges thereof, so that it is impossible to form the same into one having a series of separable sections as required for a letter paper having a series of separable printed forms, for statement of payment for instance.

The object of this invention is to provide a sealed letter which is a combination of such letter paper without coating any adhesive agent thereon that is suitable for printing out necessary descriptive matters thereon even by a thermal printer without causing any trouble thereto and separate sealable covering sheets for enclosing the foregoing printed letter paper therein, so that the printed letter paper is foldable any desired number of times and also any additional sheet such as a printed matter or the like can be enclosed therein, and accordingly a large number of the sealed letters can be made in succession in conjunction with a computer.

According to this invention, there is provided a sealed letter characterized in that letter paper on which an address and other descriptive matters are printed is covered, at its front surface, with a front sheet made of transparent paper laminated, at least at its rear surface, with a transparent and thermal adhering synthetic resin film, and is covered at its rear surface with a rear sheet made of any desired paper material, and the front sheet and the rear sheet are adhered together by heat at their peripheral portions to form an enclosed sealed portion.

Next, the process for making the sealed letter of this invention and the effect thereof will be explained as follows:

Any necessary matters of correspondence such as an address and a sum of money, for instance, or others are printed out on predetermined portions of a letter paper by a printer connected to a computer, and the resultant correspondence letter paper is so folded a desired number of times to form a folded paper of a predetermined size so that the address printed thereon may appear on the front or top surface of the folded paper.

The folded letter paper is covered, at its front surface bearing the address printed thereon, with a front sheet made of transparent paper which is laminated, at its rear surface, with a transparent and thermal adhering synthetic resin film, and the folded letter paper is covered, at its rear surface, with a rear sheet made of any desired paper material, which may be the same material as the front sheet or ordinary paper such as kraft paper or the like, for instance, and the front sheet and the rear sheet are adhered together by heat at their peripheral portions to form an enclosed sealed envelope, so that a sealed letter is produced.

With the sealed letter, the address of the letter paper can be read through the transparent front sheet, and the front sheet and the rear sheet are chiefly composed of paper material, so that the sealed letter never does lose its proper rigidity, and consequently can maintain its predetermined shape of the sealed letter, until broken manually by an addressee.

Additionally, since the letter paper is not coated with a thermal adhering agent, a thermal printer can be free from any trouble hitherto caused by the adhesive agent, and the manner of folding the letter paper is a matter of discretion except the condition that the address has to appear on the front side, so that even a large-sized letter paper can be formed into a folded small-sized one such as a fourfold one or eightfold one, and thus a lot of information can be communicated by a sealed letter.

DETAILED DESCRIPTION OF THE INVENTION

Figure 2:
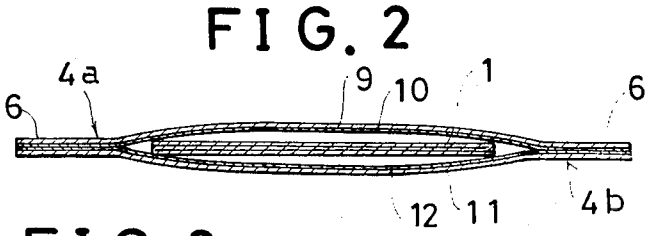
FIG. 2 is a sectional view taken along the line II-II in FIG. 1.
Figure 3:
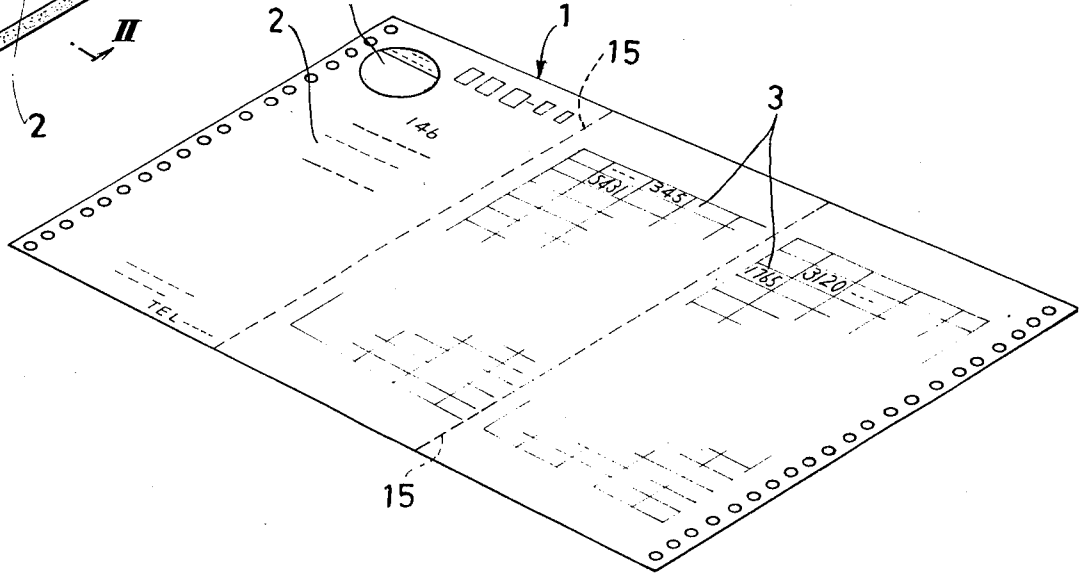
FIG. 3 is a perspective view of a letter paper thereof.
Figure 4:
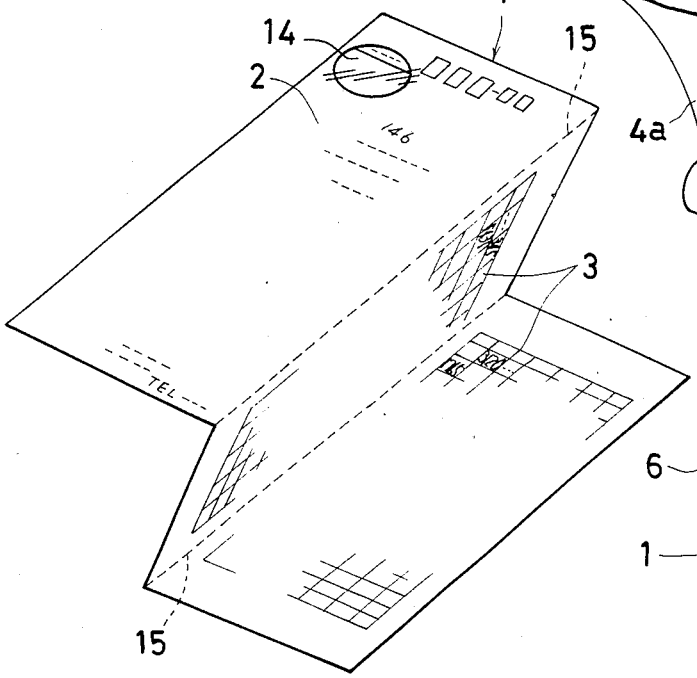
FIG. 4 is a perspective view of the same under folded condition.

Embodying examples of this invention will now be explained with reference to the accompanying drawings:

Referring to FIGS. 1–5 showing one embodying example thereof, numeral 1 denotes a letter paper for a bill, for instance, formed by printing out necessary descriptive matters such as an address 2, amounts of money 3, and others filled in the predetermined blank portions thereof by a thermal printer arranged to be operated in conjunction with a computer, and the printed letter paper 1 in an unfolded condition shown in FIG. 3 is so folded in three that the address 2 may appear on its front side and the amounts of money 3 may be on its rear side, as shown in FIG. 4.

Figure 5:
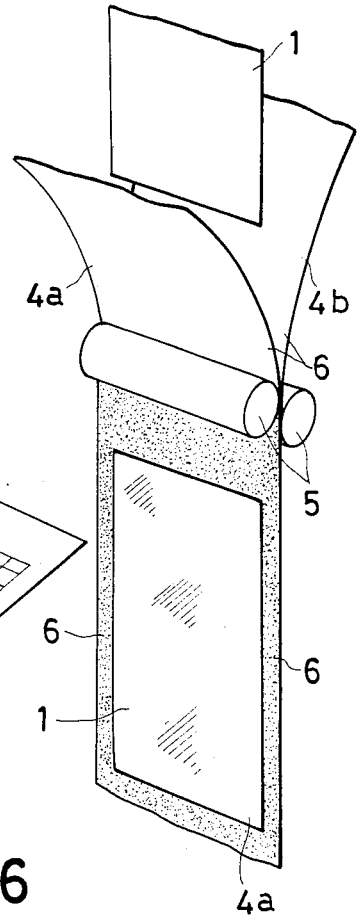
FIG. 5 is a diagram for explaining a means for making a sealed letter.

This folded letter paper 1 is inserted, as shown in FIG. 5, between a pair of long front and rear sheets 4*a*, 4*b* drawn out from respective rolls (not illustrated) for being covered therewith at its front and rear surfaces, and is heated by a pair of heating rolls 5, 5.

In this case, the front sheet 4*a* is made of transparent paper 9 such as glassine paper which is laminated, at its rear surface, with a transparent and thermal adhering synthetic resin film 10 such as of hot melt type resin, thermoplastic resin, etc., and the rear sheet 4*b* is made of transparent paper 11 which is laminated, at its front surface, with a transparent and thermal adhering synthetic resin film 12.

Figure 1:
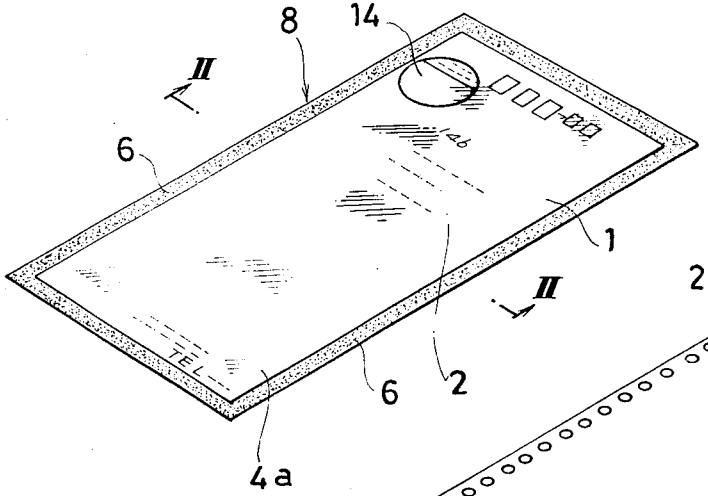
FIG. 1 is a perspective view of one embodying example of this invention.

Thus, by the foregoing heating operation, the synthetic resin films 10, 12 at such peripheral portions of the front and rear sheets 4*a*, 4*b* that surround the folded letter paper 1 are adhered together by heat to form an enclosed sealed portion 6, and thus there can be produced a sealed letter 8 as shown in FIG. 1.

Figure 6:
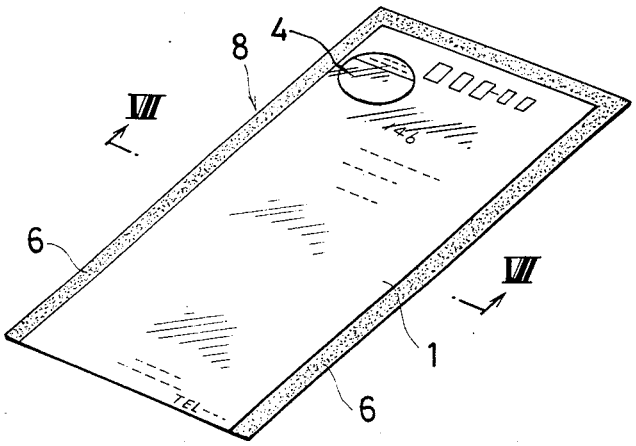
FIG. 6 is a perspective view of another example of this invention sealed letter.
Figure 8:
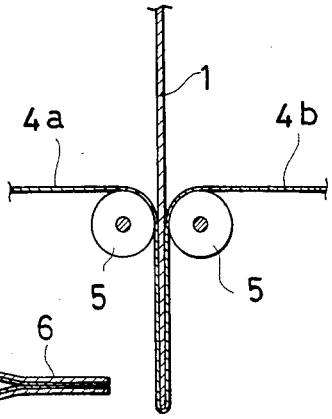
FIG. 8 is a diagram for explaining another means for making a sealed letter.
Figure 7:
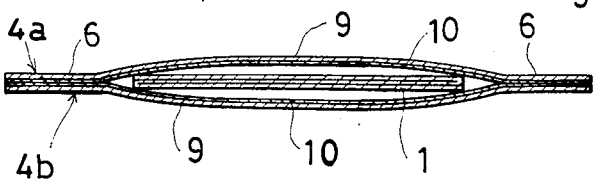
FIG. 7 is a sectional view taken along the line VII-VII in FIG. 6.

FIG. 6 and FIG. 8 show another embodying example.

If, as shown in FIG. 8, the printed letter paper 1 is interposed between the front sheet 4*a* and the rear sheet 4*b* which are formed by folding a single long sheet in two, there is produced the sealed letter 8 of such a type that out of the peripheral four sides thereof one side is lacking in the sealed portion 6 as clearly shown in FIG. 6 and that the front sheet 4*a* and the rear sheet 4*b* are made of the same materials 9 and 10.

In any of the above embodying examples, a printed matter or the like can be enclosed together with the printed letter paper 1 in the enclosed sealed sheets 4*a*, 4*b*.

The transparent paper 9 constituting the front sheet 4*a* is preferably made of glassine paper, so that characters or the like can be written thereon in water-color ink.

Figure 9:
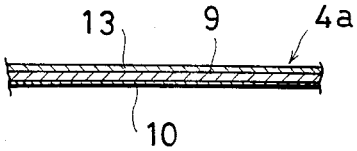
FIG. 9 is an enlarged sectional view of a modified example of a front sheet thereof.

The front sheet 4*a* may be modified so that the front surface of the transparent paper 9 thereof is also laminated with a transparent synthetic resin film 13, as shown in FIG. 9, so that a waterproof property thereof is improved and also the rigidity thereof is increased. Further, in this case, if the front synthetic resin film 13 is thicker than the rear synthetic resin film 10, breaking the sealed letter is facilitated. Numeral 14 is a stamp mark affixed onto the front surface of the letter paper 1.

Figure 10:
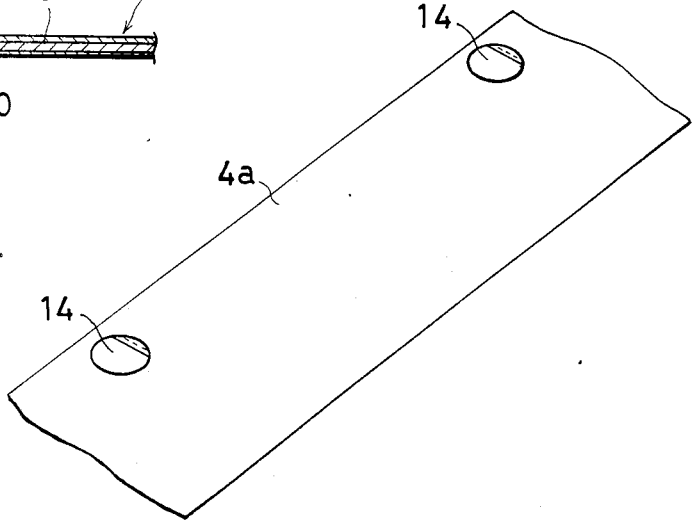
FIG. 10 is a perspective view of another example of a front sheet thereof.

Instead thereof, the front sheet 4*a* itself may be previously affixed, by printing, with a stamp mark 14 or the like, as shown in FIG. 10.

Figure 11:
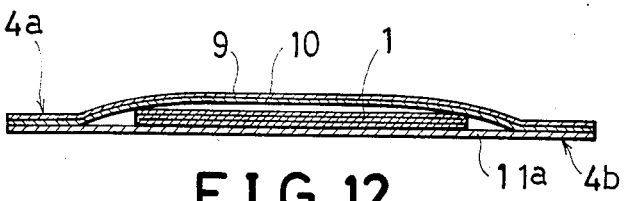
FIGS. 11 and 12 are enlarged sectional views of further modified examples of this invention sealed letter.
Figure 12:
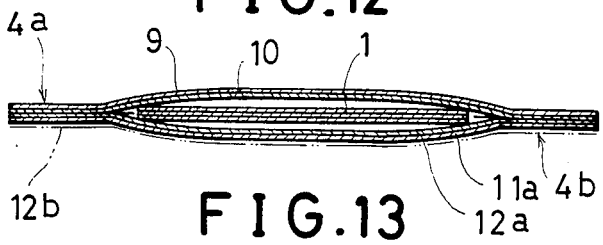

In another embodying example shown in FIG. 11, the rear sheet 4*b* is made of opaque ordinary paper 11*a* such as kraft paper, roll paper or the like, and in a further another embodying example shown in FIG. 12, the rear sheet 4*b* is formed of a lamination of an opaque paper 11*a* and a thermal adhering synthetic resin film 12*a* applied to a front surface of the paper 11*a*.

In the latter case, the paper 11*a* may be applied also on its rear surface with a synthetic resin film 12*b*, as shown by a chain line in the same Figure.

Figure 13:
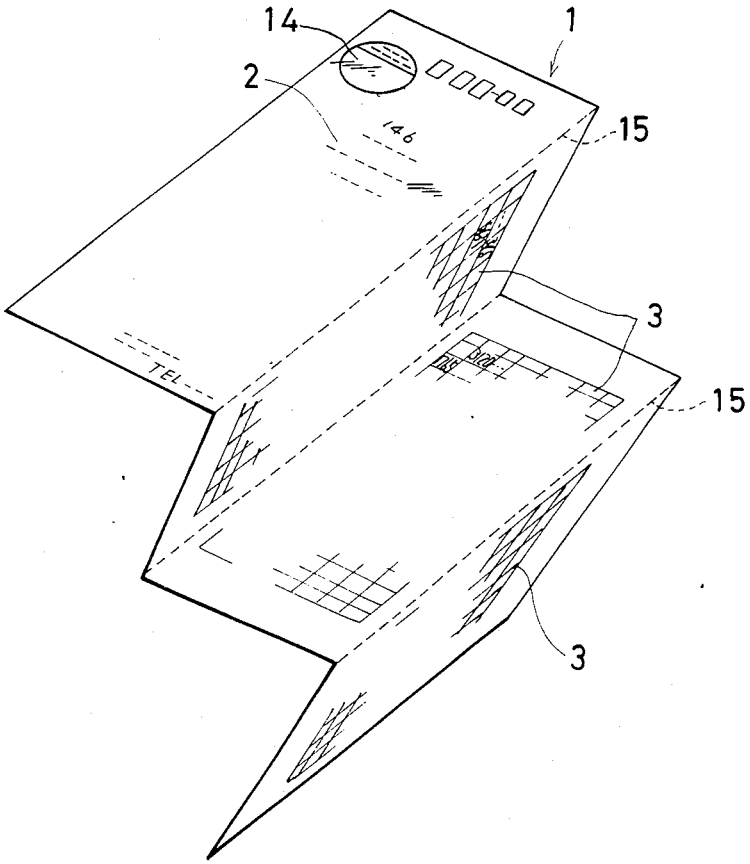
FIG. 13 is a perspective view of a letter paper under folded condition.

If the rear sheet 4*b* is opaque as shown in these examples, even when the printed letter paper 1 is folded so that the last section thereof including the correspondence contents may appear on its rear surface, as shown in FIG. 13, the rear surface thereof is covered with the rear sheet 4*b* and cannot be seen from outside and therefore the last section of the printed letter paper can be utilized effectively for correspondence description.

Referring to the drawings, numeral 15 denotes a folding line, and the folding line may be provided with perforations so that the letter paper may be formed of plural separable sections.

Thus, according to this invention, letter paper on which an address and any other necessary matters are printed by a printer of a computer is covered, at its front surface, with front sheet made of transparent paper applied with a transparent and thermal adhering synthetic resin film, and is covered, at its rear surface,with a rear sheet made of any paper material, and the front sheet and the rear sheet are adhered together by heat at their peripheral portions so as to form a sealed letter, so that any coating of an adhesive agent on the letter paper can be eliminated, and consequently there can be removed such a trouble as disorder of a thermal printer caused by the adhesive agent. Additionally, the manner of folding the letter paper can be carried out in any manner provided that the printed address thereof should appear on the front surface.

Additionally, for the front sheet and the rear sheet are made chiefly of paper material, the sealed letter can be easily broken for opening the same, and for the front sheet has the synthetic resin film, it can prevent the sealed letter from getting wet with rain or the like.

I claim:

1. A sealed letter characterized in that the letter paper on which an address or other descriptive matters are printed is covered, (1) on its front surface with a long, continuous front sheet made of transparent paper which is laminated on its rear surface with a transparent and thermal adhering synthetic resin film and, (2) on its rear surface with a long, continuous rear sheet made of a paper material, wherein the front sheet and the rear sheet are adhered together by heat at their peripheral portions to form an enclosed sealed portion.

2. A sealed letter as claimed in claim 1, wherein the transparent paper constituting the front sheet is made of glassine paper.

3. A sealed letter as claimed in claim 1, wherein the rear sheet is made of transparent paper laminated, at least at its front surface, with a transparent and thermal adhering synthetic resin film.

4. A sealed letter as claimed in claim 3, wherein the transparent paper constituting the rear sheet is provided on its rear surface with a synthetic resin film.

5. A sealed letter as claimed in claim 1, wherein the rear sheet is made of opaque paper.

6. A sealed letter as claimed in cliam 5, wherein the opaque paper is provided on its front surface with a synthetic thermal adhering resin film.

7. A sealed letter as claimed in claim 6, wherein the opaque paper is provided on its rear surface with a synthetic resin film.

8. A sealed letter as claimed in claim 1, wherein the letter paper is in a folded condition.

* * * * *

UNITED STATES PATENT AND TRADEMARK OFFICE

CERTIFICATE OF CORRECTION

PATENT NO. : 4,801,074

DATED : January 31, 1989

INVENTOR(S) : Etsujiro IKEDA

It is certified that error appears in the above-identified patent and that said Letters Patent is hereby corrected as shown below:

On the cover page, Item [30] "36-113495[U]" should read --61-113495[U]--.

Signed and Sealed this

Fourteenth Day of November, 1989

*Attest:*

JEFFREY M. SAMUELS

*Attesting Officer*

*Acting Commissioner of Patents and Trademarks*